US009472885B2

(12) United States Patent
Morello et al.

(10) Patent No.: US 9,472,885 B2
(45) Date of Patent: Oct. 18, 2016

(54) ELECTRICAL CONNECTOR ASSEMBLY WITH LOW TERMINAL INSERTION FORCE

(71) Applicant: DELPHI TECHNOLOGIES, INC., Troy, MI (US)

(72) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/563,053

(22) Filed: Dec. 8, 2014

(65) Prior Publication Data

US 2016/0164213 A1 Jun. 9, 2016

(51) Int. Cl.
*H01R 13/428* (2006.01)
*H01R 13/436* (2006.01)

(52) U.S. Cl.
CPC ..... *H01R 13/4367* (2013.01)

(58) Field of Classification Search
CPC H01R 13/432; H01R 13/426; H01R 13/434; H01R 13/428; H01R 13/422
USPC ..... 439/744, 746, 872, 839, 562
See application file for complete search history.

(56) References Cited

U.S. PATENT DOCUMENTS 4,046,450 A * 9/1977 Yurtin ..... H01R 13/428 439/746
5,288,243 A * 2/1994 Mergless ..... H01R 13/6272 439/357
5,769,555 A * 6/1998 Okada ..... H01R 13/422 403/14
5,980,318 A 11/1999 Morello et al.
6,174,208 B1 * 1/2001 Chen ..... H01R 13/113 439/752.5
7,048,584 B1 5/2006 Morello et al.
7,252,553 B2 8/2007 Morello et al.
7,294,027 B1 11/2007 Tyler
7,396,255 B2 * 7/2008 Morello ..... H01R 13/4223 439/595
9,160,082 B2 * 10/2015 Heringhaus ..... H01R 13/187
9,236,675 B2 * 1/2016 Tsuji ..... H01R 13/187
2005/0118884 A1 * 6/2005 Lutsch ..... H01R 13/428 439/746
2007/0049088 A1 * 3/2007 Mohs ..... H01R 13/18 439/265
2008/0096442 A1 4/2008 Fukaya et al.

(Continued)

FOREIGN PATENT DOCUMENTS

JP 2008004342 A 1/2008
JP 2009259490 A 11/2009

OTHER PUBLICATIONS

International Search Report for International Appl. No. PCT/US2015/046931, published Nov. 27, 2015.

*Primary Examiner* — Abdullah Riyami
*Assistant Examiner* — Thang Nguyen
(74) *Attorney, Agent, or Firm* — Robert J. Myers

(57) ABSTRACT

An electrical connector assembly comprising a wire attached to a terminal and a connector body. The terminal defines a pair of terminal wings protruding from opposite side surfaces of the terminal. A cavity within the connector body is configured to receive the terminal. Side walls of the cavity define terminal guides that have guide rails and a guide slots beneath the guide rails. As the terminal is pushed into the cavity, the guide rails urge the terminal wings toward a top wall of the cavity until the terminal wings reach an end of the guide rails. The terminal wings then enter open ends of the guide slots as the wire is pulled cavity and the terminal wings traverse the guide slots until the terminal wings engage closed ends of the guide slots and/or a terminal lock tab engages a lock surface within the cavity, thereby preventing the terminal from being inadvertently withdrawn from the cavity.

18 Claims, 9 Drawing Sheets

(56) References Cited

U.S. PATENT DOCUMENTS

2008/0146091 A1* 6/2008 Tyler ..... H01R 13/03
439/843
2008/0305681 A1* 12/2008 Hiramatsu ..... H01R 13/08
439/595
2010/0041272 A1* 2/2010 Morello ..... H01R 13/4223
439/595
2010/0041280 A1* 2/2010 Morello ..... H01R 13/422
439/752
2011/0136397 A1* 6/2011 Koga ..... H01R 4/185
439/877
2014/0051307 A1* 2/2014 Aoki ..... H01R 13/432
439/746
2016/0056575 A1* 2/2016 Morello ..... H01R 13/6275
439/352

* cited by examiner

ELECTRICAL CONNECTOR ASSEMBLY WITH LOW TERMINAL INSERTION FORCE

TECHNICAL FIELD OF THE INVENTION

The invention relates to electrical connector assemblies, particularly electrical connector assemblies having a connector body that requires a low terminal insertion force.

BACKGROUND OF THE INVENTION

U.S. Pat. No. 5,980,318 granted to John Morello, et al. on Nov. 9, 1999 discloses an electrical connector comprising a connector body that has a plurality of terminal receiving cavities. Each terminal receiving cavity is defined in part by a rigid floor and opposed upright walls. A rigid lock nib extends upwardly from the rigid floor into the terminal receiving cavity. A flexible beam opposes the rigid floor and engages a terminal in the cavity to hold the terminal against the rigid lock nib to retain the terminal in the terminal receiving cavity. The connector body is constructed and arranged for receiving a terminal in each terminal receiving cavity. This electrical connector is well suited for its intended purpose of housing and retaining terminals.

However, the flexible beam causes a frictional resistance against the terminal as it is inserted into the terminal receiving cavity. This frictional resistance must be overcome by a terminal inserting force applied to a wire lead attached to the terminal. As the cross sectional size of terminals and the diameter of wire leads are reduced, the insertion force is more likely to cause undesirable bending of the wire lead and/or the terminal when the terminal is inserted into the terminal receiving cavity. Therefore, a connector body having a reduced terminal insertion force is desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrical connector assembly is provided. The electrical connector assembly includes a wire and a terminal having a first end, a second end secured to the wire, and a terminal body between the first and second ends. The terminal body defines a pair of terminal wings protruding from opposite side surfaces of the terminal body. The electrical connector assembly further includes a connector body having a terminal receiving cavity formed therein and having a first opening configured for insertion of the terminal therethrough and having a second opening opposite the first opening configured to receive a mating terminal therethrough. The terminal receiving cavity is defined in part by a bottom wall, a top wall opposing the bottom wall, and two opposed side walls adjacent the top and bottom walls. Each of said side walls define terminal guides protruding into the terminal receiving cavity. The terminal guides have guide rails and a guide slots beneath the guide rails. The guide rails are configured to urge the pair of terminal wings toward the top wall as the terminal and the wire are inserted within the terminal receiving cavity through the first opening until the pair of terminal wings reach an end of the guide rails. The pair of terminal wings are configured to enter open ends of the guide slots as the wire is withdrawn from the terminal receiving cavity and the pair of terminal wings traverse the guide slots until the pair of terminal wings engage closed ends of the guide slots, thereby preventing the terminal from being inadvertently withdrawn from the terminal receiving cavity through the first opening.

The bottom wall may define a first lock surface that is substantially perpendicular to the bottom wall. A bottom surface of the terminal body may define a first lock tab located proximate the second end of the terminal. As used herein, proximate means that the first lock tab is located within no more than 5 millimeters from the second end of the terminal. The first lock tab may be configured to engage the first lock surface, thereby preventing the terminal from being inadvertently withdrawn from the terminal receiving cavity through the first opening. The bottom wall may define a second lock surface that is substantially perpendicular to the bottom wall. The bottom surface of the terminal body may define a second lock tab that is located proximate the first end of the terminal. As used herein, proximate means that the second lock tab is located within no more than 5 millimeters from the first end of the terminal. The second lock tab may be configured to engage the second lock surface, thereby preventing the terminal from being inadvertently withdrawn from the terminal receiving cavity through the second opening.

The electrical connector assembly may further include a retainer that is affixed to the second opening and is configured to engage the first end of the terminal, thereby preventing the terminal from being inadvertently withdrawn from the terminal receiving cavity through the second opening. The retainer may define a retainer cavity that is characterized, in part, by a lower wall and an upper wall opposing the lower wall. The retainer cavity is configured to receive the connector body. The retainer may be moveable from an initial position to a final position. The retainer allows insertion of the terminal into the terminal receiving cavity and entry of the pair of terminal wings into the open ends of the guide slots when it is in the initial position. The retainer engages the first end of the terminal, thereby preventing the pair of terminal wings from disengaging the guide slots when it is in the final position. The retainer cavity may define a cam surface that is forwardly sloping from the upper wall of the retainer cavity toward the lower wall of the retainer cavity. The cam surface is configured to engage the first end of the terminal as the pair of terminal wings reaches the end of the guide rails, thereby biasing the pair of terminal wings to enter the open ends of the guide slots when the retainer is in the initial position.

The terminal body is intermediate the guide rails as the terminal and the wire is inserted within the terminal receiving cavity through the first opening.

The terminal may be a female terminal and the mating terminal may be a male terminal. The first end of the terminal is open to receive the male terminal. Alternatively, the terminal may be a male terminal and the mating terminal may be a female terminal.

The electrical connector assembly may include a plurality of terminals and a plurality of wires may be individually secured to this plurality of terminals. The connector body may a plurality of terminal receiving cavities formed therein configured to individually receive the plurality of terminals.

In accordance with another embodiment, another electrical connector assembly is provided. This electrical connector assembly includes a wire and a terminal having a forward end, a rearward end secured to the wire, and a terminal body between the forward and rearward ends. The terminal body defines a pair of terminal wings protruding from opposite side surfaces of the terminal body and a bottom surface of the terminal body defines a rearward lock tab that is located proximate the rearward end of the terminal. As used herein, proximate means that the rearward lock tab is located within no more than 5 millimeters from the rearward end of the terminal. The electrical connector assembly also includes a connector body having a terminal receiving cavity formed therein. The terminal receiving cavity has a rearward opening configured for insertion of the terminal therethrough and has a forward opening opposite the rearward opening configured to receive a mating terminal therethrough. The terminal receiving cavity is defined in part by a bottom wall having a rearward lock surface that is substantially perpendicular to the bottom wall, a top wall opposing the bottom wall, and two opposed side walls adjacent the top and bottom walls. Each of the side walls define terminal guides that protrude into the terminal receiving cavity. The terminal guides have guide rails and a guide slots beneath the guide rails. Each guide slot has a forward open end. The electrical connector assembly further includes a retainer affixed to the forward opening. The retainer has a retainer cavity that is defined in part by a lower wall and an upper wall opposing the lower wall. The retainer cavity is configured to receive the connector body. The retainer cavity defines a cam surface that is forwardly sloping from the upper wall of the retainer cavity toward the lower wall of the retainer cavity. The guide rails are configured to urge the pair of terminal wings toward the top wall as the terminal and the wire are inserted into the terminal receiving cavity in a forward direction until the forward end of the terminal engages the cam surface of the retainer, thereby urging the pair of terminal wings toward the forward open ends of the guide slots. The open ends of the guide slots are configured to receive the pair of terminal wings as the terminal and the wire are moved in a rearward direction. The pair of terminal wings is configured to traverse the guide slots until the rearward lock tab engages the rearward lock tab, thereby preventing the terminal from being inadvertently withdrawn from the terminal receiving cavity through the rearward opening.

The bottom wall of the terminal receiving cavity may define a forward lock surface that is substantially perpendicular to the bottom wall. The bottom surface of the terminal body may define a forward lock tab that is located proximate to the forward end of the terminal. As used herein, proximate means that the forward lock tab is located within no more than 5 millimeters from the forward end of the terminal. The forward lock tab may be configured to engage the forward lock surface, thereby preventing the terminal from being inadvertently withdrawn from the terminal receiving cavity through the forward opening.

The retainer may be configured to engage the forward end of the terminal, thereby preventing the terminal from being inadvertently withdrawn from the terminal receiving cavity through the forward opening. The retainer may be moveable from an initial position to a final position. In the initial position, the retainer allows insertion of the terminal into the terminal receiving cavity and entry of the pair of terminal wings into the open ends of the guide slots. In the final position, the retainer engages the forward end of the terminal, thereby preventing the pair of terminal wings from disengaging the guide slots.

The terminal body is intermediate the guide rails as the terminal and the wire is inserted within the terminal receiving cavity through the rearward opening.

The guide slots may have a rearward closed end and the pair of terminal wings engages the rearward closed ends of the guide slots, thereby preventing the terminal from being inadvertently withdrawn from the terminal receiving cavity through the rearward opening.

The terminal may be a female terminal and the mating terminal may be a male terminal. The forward end of the female terminal is open to receive the male terminal. Alternatively, the terminal may be a male terminal and the mating terminal may be a female terminal.

The electrical connector assembly may include a plurality of terminals and a plurality of wires that are individually secured to this plurality of terminals. The connector body may have a plurality of terminal receiving cavities formed therein that are configured to individually receive the plurality of terminals.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

An electrical connector assembly is presented herein. The electrical connector assembly includes a terminal, such as a female receptacle terminal, that is configured to attach with a corresponding mating terminal, such as a male plug terminal. The terminal is attached to an electrical wire. The terminal is contained within a terminal receiving cavity of an insulative connector body. The terminal and the terminal receiving cavity have a number of locking features that secure the terminal within the cavity by inserting the terminal and a section of the wire within the terminal receiving cavity and then partially withdrawing the section of the wire to engage the locking features. This process that is used to install the terminal within the connector body is sometimes referred to as a "push-pull-click" process.

Figure 1:
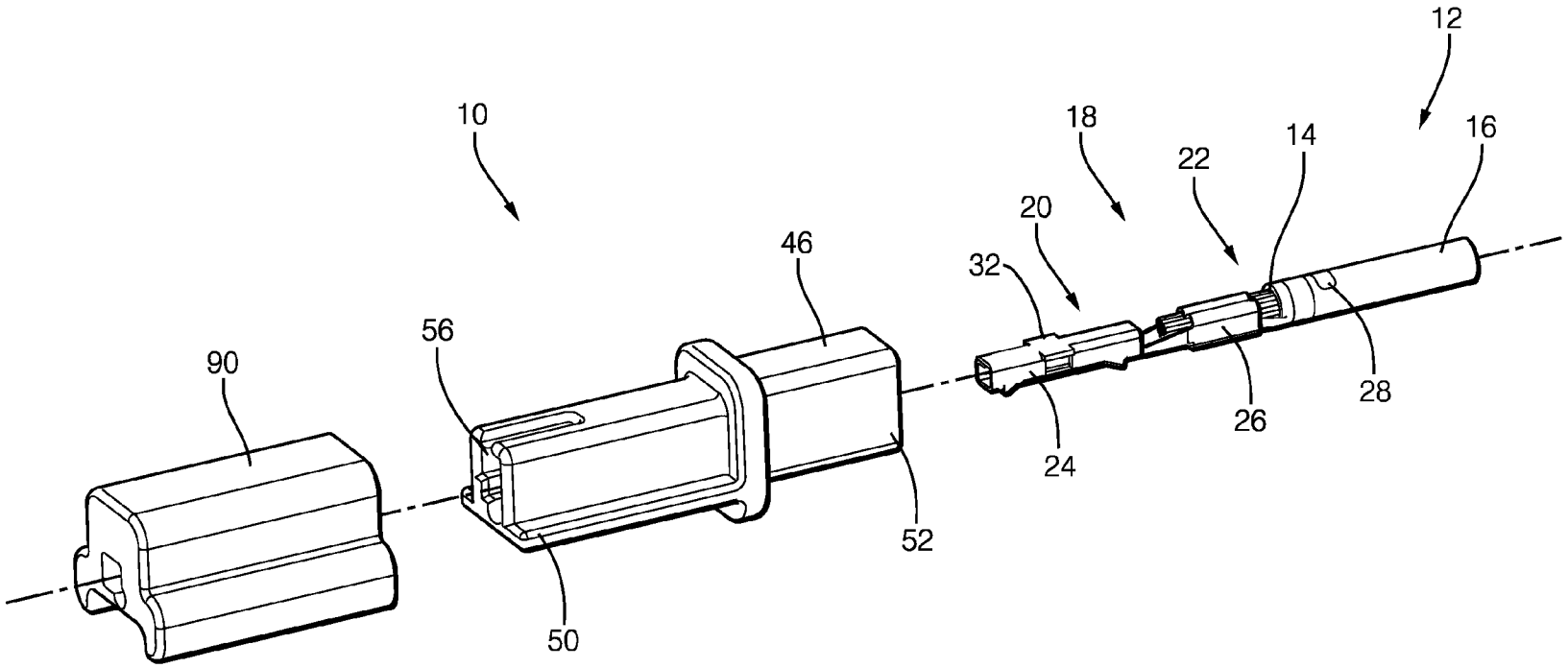
FIG. 1 is an exploded perspective view of an electrical connector assembly according to one embodiment.

FIG. 1 illustrates a non-limiting example of such an electrical connector assembly, generally referred to as the assembly and having the reference number 10. The assembly 10 includes an insulated electrical wire 12 having a conductive core 14 made of copper, aluminum, or any other suitably conducive material. The conductive core 14 is surrounded by a flexible insulative jacket 16.

The assembly 10 further includes an electrical terminal 18 having a forward end 20, a rearward end 22, and a terminal body 24 between the forward and rearward ends 20, 22. The rearward end 22 of the terminal 18 includes two sets of crimp wings. The first set is wire crimp wings 26 that are used to attach the terminal 18 to the conductive core 14 of the wire 12. The second set is insulation crimp wings 28 that attach the terminal 18 to the insulative jacket of the wire 12. A top surface 30 of the terminal body 24 defines a pair of terminal wings 32 that protrude laterally away from opposite side surfaces 34 of the terminal body 24. A bottom surface 36 of the terminal body 24 defines a rearward lock tab 38 located proximate the rearward end 22 of the terminal 18 and a forward lock tab 40 located proximate the forward end 20 of the terminal 18. The rearward lock tab 38 defines a rearward face 42 that is substantially perpendicular to the bottom surface 36 and the forward lock tab 40 defines a forward face 44 that is substantially perpendicular to the bottom surface 36. As used herein, substantially perpendicular is ±5° of absolutely perpendicular.

The assembly 10 also includes a connector body 46 that is configured to hold the terminal 18. The connector body 46 has a terminal receiving cavity 48 formed within and extending from a forward end 50 of the connector body 46 to a rearward end 52. The connector body 46 has a rearward opening 54 of the terminal receiving cavity 48 that is configured for insertion of the terminal 18 therethrough. The connector body 46 further has a forward opening 56 opposite the rearward opening 54 that is configured to receive the mating terminal (not shown) therethrough. The connector body 46 also includes a retainer tab 58 and a stop ridge 60.

Figure 2:
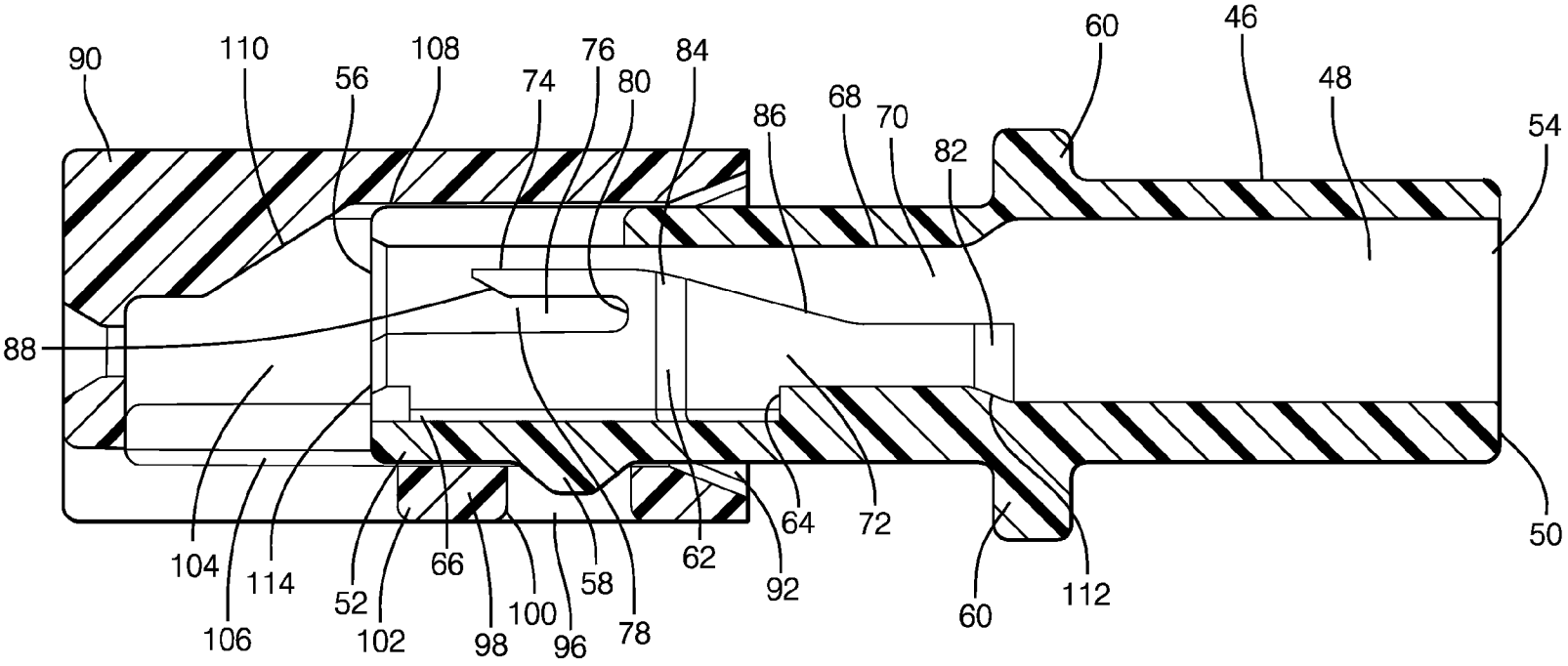
FIG. 2 is a side cross section view of the connector body and retainer of the electrical connector assembly of FIG. 1 according to one embodiment.

As illustrated in the cross section drawing of the connector body 46 in FIG. 2, the terminal receiving cavity 48 is defined, in part, by a bottom wall 62 having a rearward lock surface 64 and a forward lock surface 66 that are both substantially perpendicular to the bottom wall 62, a top wall 68 opposing the bottom wall 62, and two opposed side walls 70 adjacent the top and bottom walls 68, 62. Only a first side wall 70 is shown in FIG. 2. A second opposing side wall (not shown) is a mirror image of the first side wall 70. Each of the side walls 70 define terminal guides 72 that protrude from the side walls 70 and into the terminal receiving cavity 48. The terminal guides 72 have guide rails 74 and guide slots 76 beneath the guide rails 74. Each guide slot 76 has a forward open end 78 and a rearward closed end 80. The guide rails 74 have a rearward and forward lateral ramp 82, 84 that each are forwardly sloping from the sidewalls toward the interior of the terminal receiving cavity 48. Each of the guide rails 74 further include a rearward vertical ramp 86 that is forwardly sloping toward the top wall 68 of the terminal receiving cavity 48. The end of each guide rail 74 defines a forward vertical ramp 88 that slopes rearwardly from the end of the guide rail 74 into the open end 78 of the guide slot 76. The terminal guides 72 are configured to engage the terminal wings 32 of the terminal 18 in a manner that will be explained below.

Figure 3A:
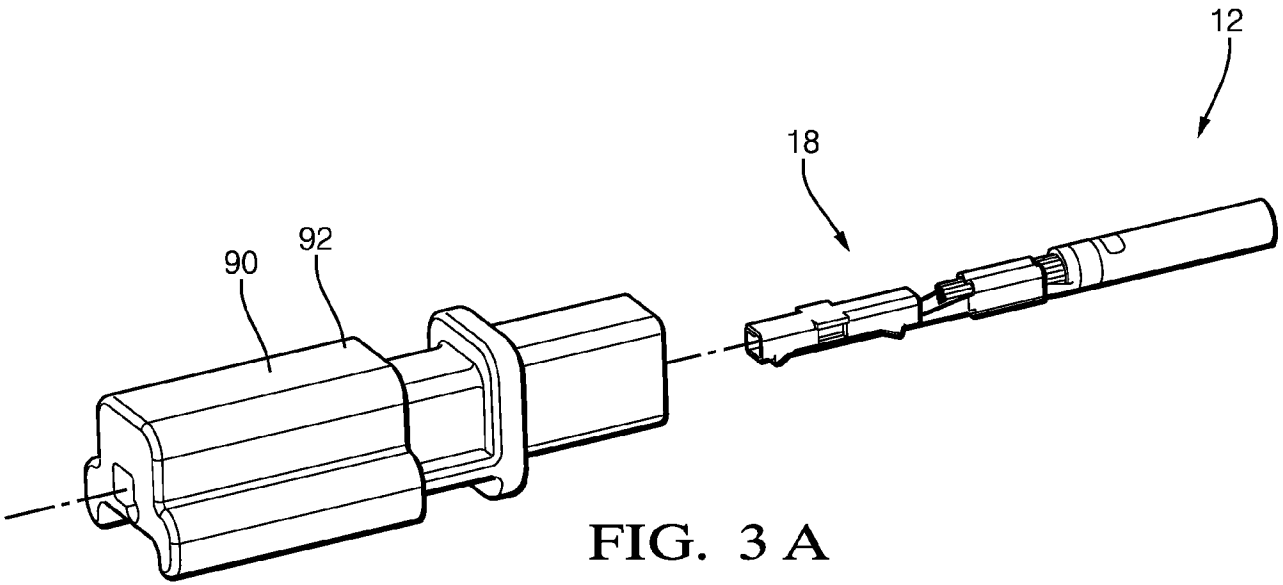
FIG. 3A is a perspective view of the connector body and retainer of the electrical connector assembly of FIG. 1 in an initial position prior to the insertion of the terminal within the terminal reviving cavity according to one embodiment.
Figure 3B:
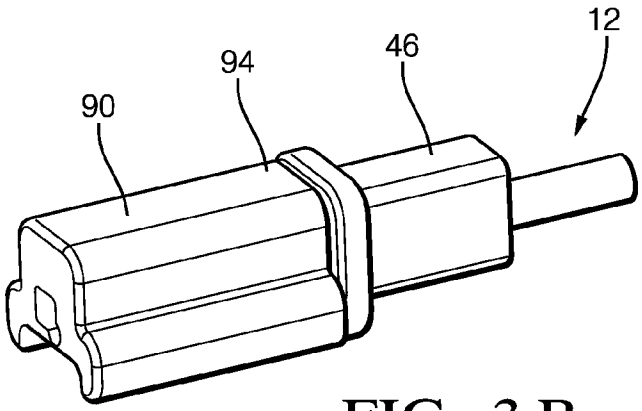
FIG. 3B is a perspective view of the connector body and retainer of the electrical connector assembly of FIG. 1 in a final position following the insertion of the terminal within the terminal reviving cavity according to one embodiment.

According to the illustrated example, the assembly 10 additionally includes a retainer 90 affixed to the forward opening 56. The retainer 90 is movable from an initial position 92 in which the terminal 18 can be received into the terminal receiving cavity 48 as shown in FIG. 3A to a final position 94 after the terminal 18 is secured within the connector body 46 as shown in FIG. 3B. A retainer slot 96 is bridged by a retainer bar 98. The retainer tab 58 of the connector body 46 is located on a rearward side 100 of the retainer bar 98 when the retainer 90 is in the initial position 92 and the retainer tab 58 is located on a forward side 102 of the retainer bar 98 when the retainer 90 is in the final position 94. Additionally, the retainer 90 may contact the stop ridge 60 of the connector body 46 to prevent any further rearward movement of the retainer 90 when the retainer 90 is in the final position 94.

As illustrated in FIG. 2, the retainer 90 has a retainer cavity 104 that is defined in part by a lower wall 106 and an upper wall 108 opposing the lower wall 106. The retainer cavity 104 is configured to receive the connector body 46. The retainer cavity 104 defines a cam surface 110 that is forwardly sloping from the upper wall 108 of the retainer cavity 104 toward the lower wall 106 of the retainer cavity 104. The connector body 46 and the retainer 90 may be formed of a non-conductive polymer, such as glass filled polybutylene terephthalate (PBT).

The structure and the function of the terminal guides 72 of the connector body 46 and the terminal wings 32 of the terminal 18 will now be explained with references to FIGS. 4 to 9.

Figure 4:
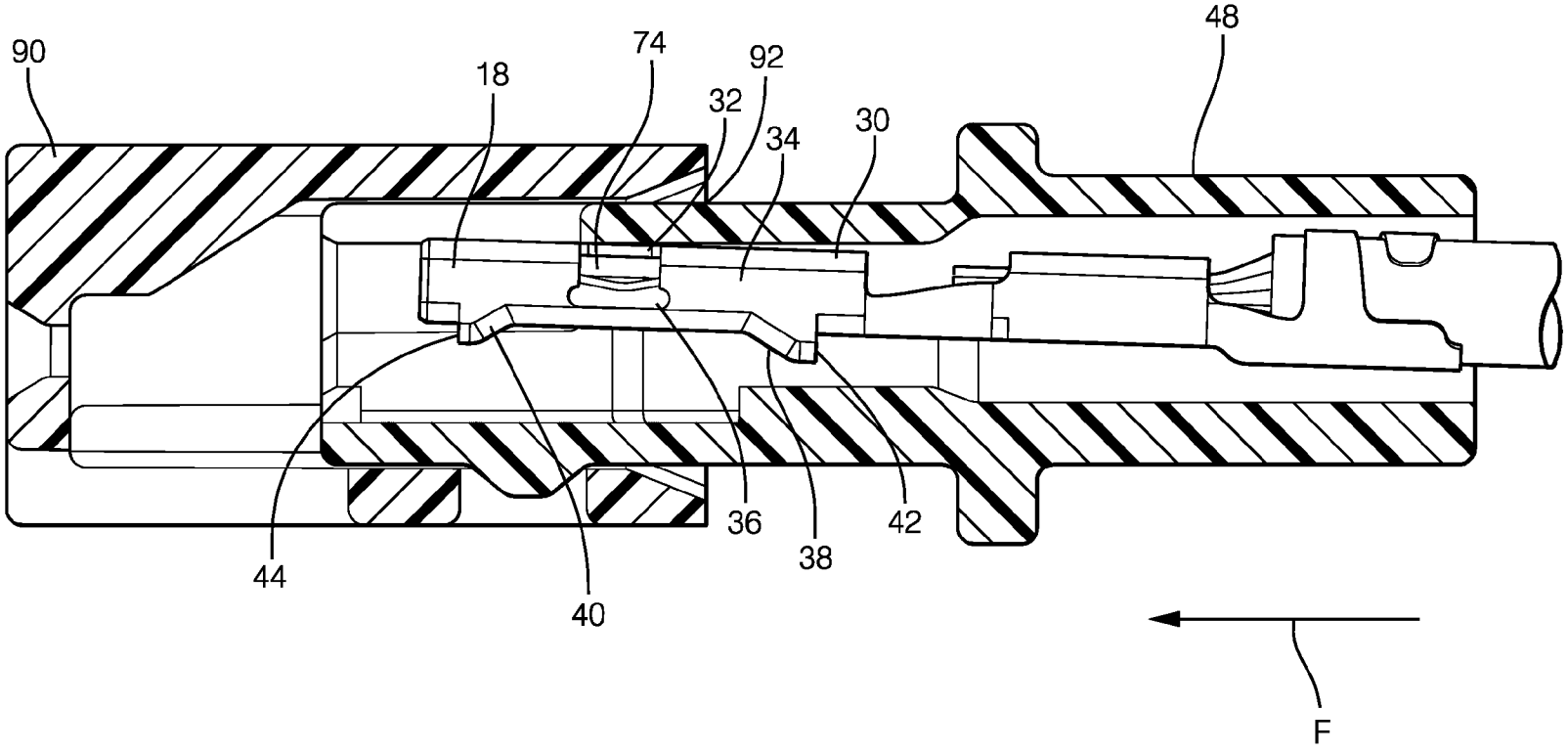
FIG. 4 is a side cross section view of the connector body and retainer of the electrical connector assembly of FIG. 1 while the terminal is engaging the guide rails as it is pushed within the terminal receiving cavity according to one embodiment.

FIG. 4 illustrates the terminal 18 partially inserted into the terminal receiving cavity 48 by pushing the terminal 18 and wire 12 in a forward direction F. As the terminal 18 is inserted, the forward end 20 of the terminal 18 engages the rearward lateral ramps 82, directing the terminal 18 between the terminal guides 72. As the terminal 18 is further inserted into the terminal receiving cavity 48, the terminal wings 32 contact the top surface of the rearward vertical ramps and the terminal 18 is urged toward the top wall 68 of the terminal receiving cavity 48 so that the terminal 18 is above the guide slots 76. The forward end 20 of the terminal 18 also contacts the forward lateral ramps 84 so that the terminal 18 is more precisely aligned between the terminal guides 72. The rearward vertical ramp 86 may also cooperate with a bottom vertical ramp 112 defined by the connector body 46 to ensure that the rearward lock tab 38 of the terminal 18 clears the rearward lock surface 64 of the connector body 46 as the terminal 18 is inserted.

Figure 5:
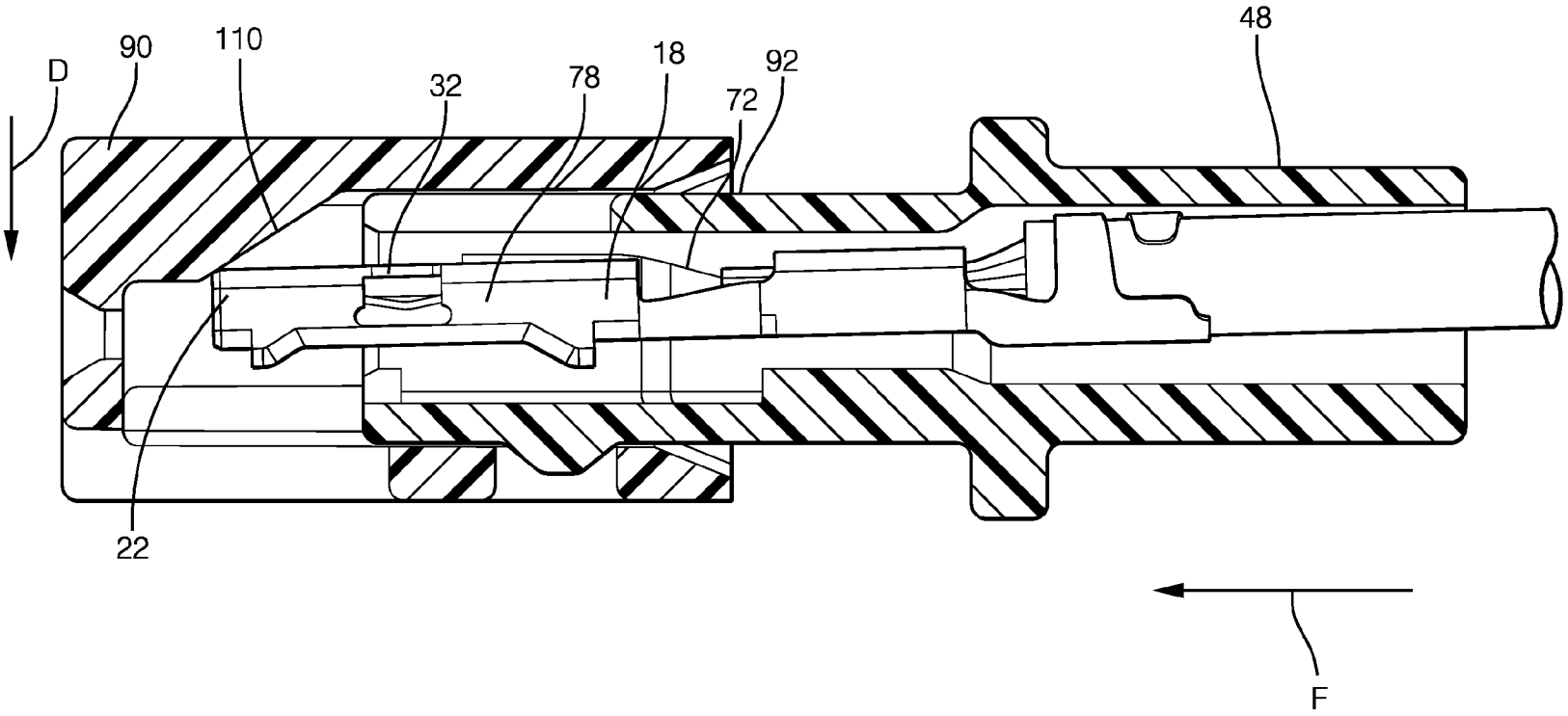
FIG. 5 is a side cross section view of the connector body and retainer of the electrical connector assembly of FIG. 1 while the terminal is engaging the guide rails as it is pushed further within the terminal receiving cavity according to one embodiment.

As illustrated in FIG. 5, the terminal 18 in inserted until the terminal wings 32 move past the end of the guide rails 74. The forward end 20 of the terminal 18 contacts the cam surface 110 of the retainer 90 and the terminal 18 is urged in a downward direction D, i.e. toward the bottom surface 36 and toward the open ends 78 of the guide slots 76.

Figure 6:
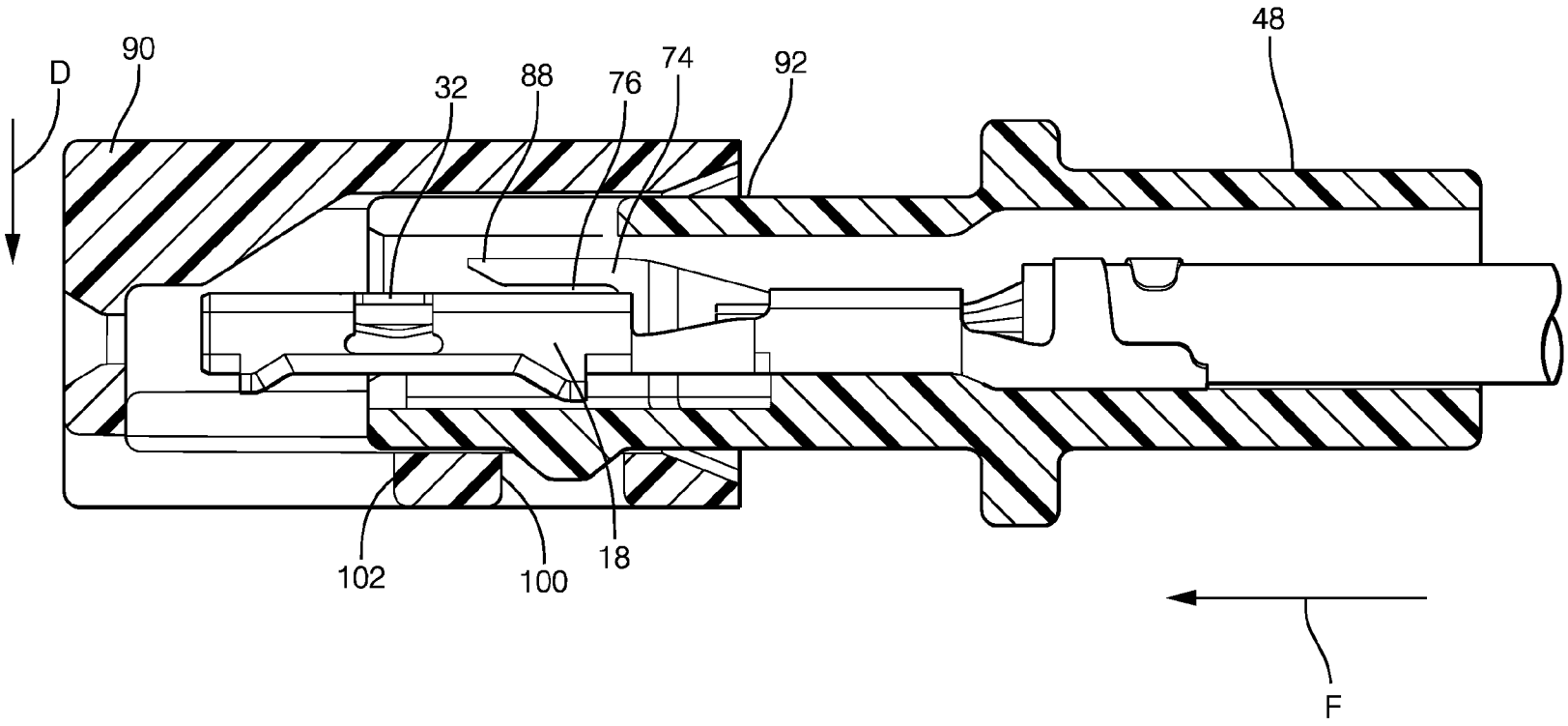
FIG. 6 is a side cross section view of the connector body and retainer of the electrical connector assembly of FIG. 1 as the terminal is engaging the guide slots within the terminal receiving cavity according to one embodiment.

As illustrated in FIG. 6, the terminal 18 moves along the cam surface 110 until the bottom surface 36 of the terminal 18 is in close proximity to, or in contact with, the bottom wall 62 of the connector body 46. At this point the terminal wings 32 are near the open end 78 of the guide slot 76.

Figure 7:
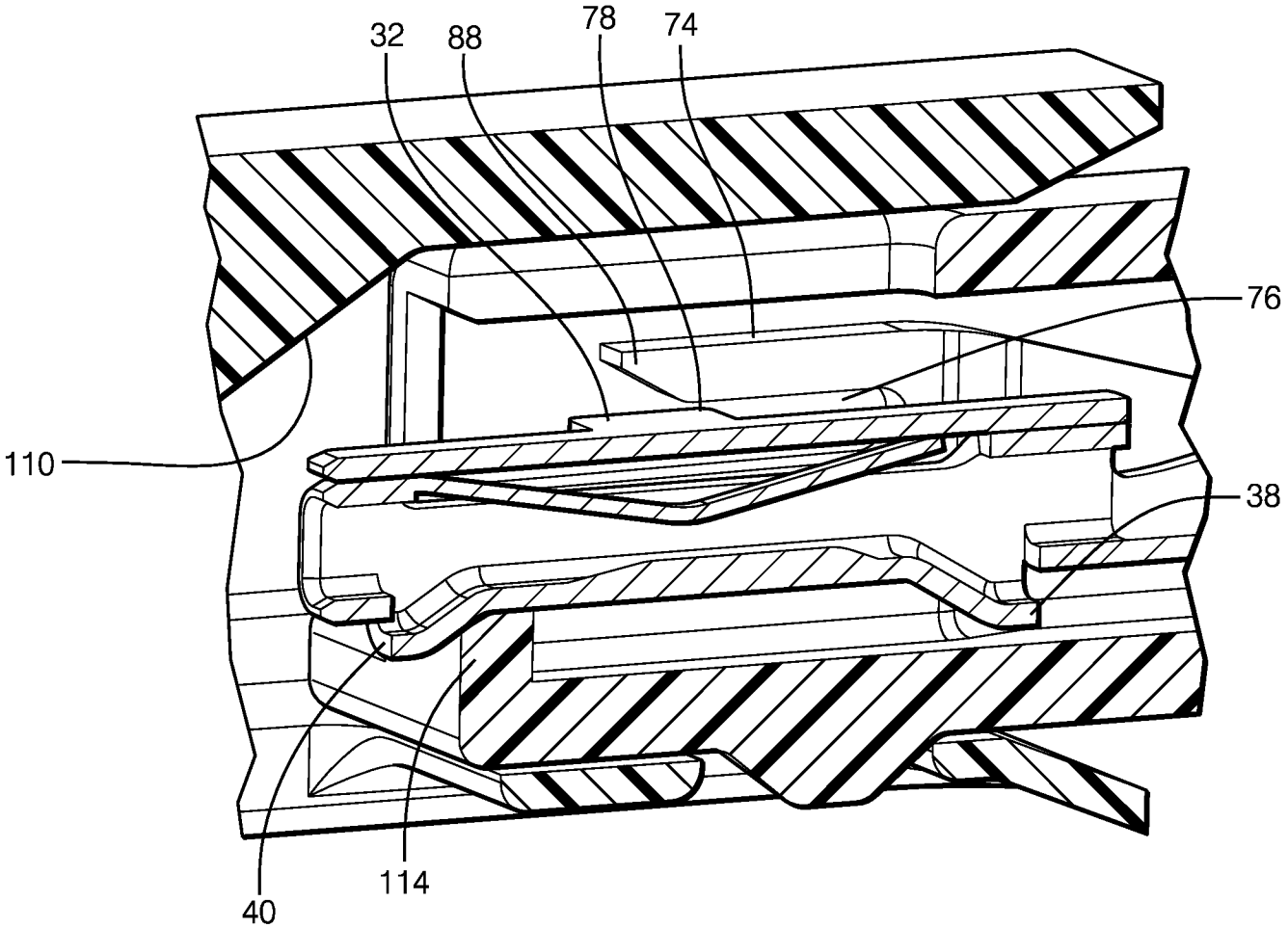
FIG. 7 is a perspective cross section view of the connector body and retainer of the electrical connector assembly of FIG. 1 as the wire is partially withdrawn from the terminal receiving cavity, thereby traversing the terminal wings through the guide slots according to one embodiment.

As shown in FIG. 7, the wire 12 and terminal 18 are pulled in a rearward direction R so that a portion of the wire 12 is withdrawn from the terminal receiving cavity 48 so that the terminal wings 32 enter the guide slot 76. As the forward lock tab 40 contacts the forward edge of the connector body 46, the sloped face of the forward lock tab 40 contacts a forward ramp 114 of the connecter body and the forward lock tab 40 will move up and over the forward ramp 114 as the wire 12 is pulled in the rearward direction R. A space between the terminal tabs and a flexing of the terminal wings 32 as they contact an upper surface of the guide slot 76 will allow the forward locking tab to move over the forward ramp 114. The forward lock tab 40 may produce an audible "click" as it moves over the forward ramp 114.

Figure 8:
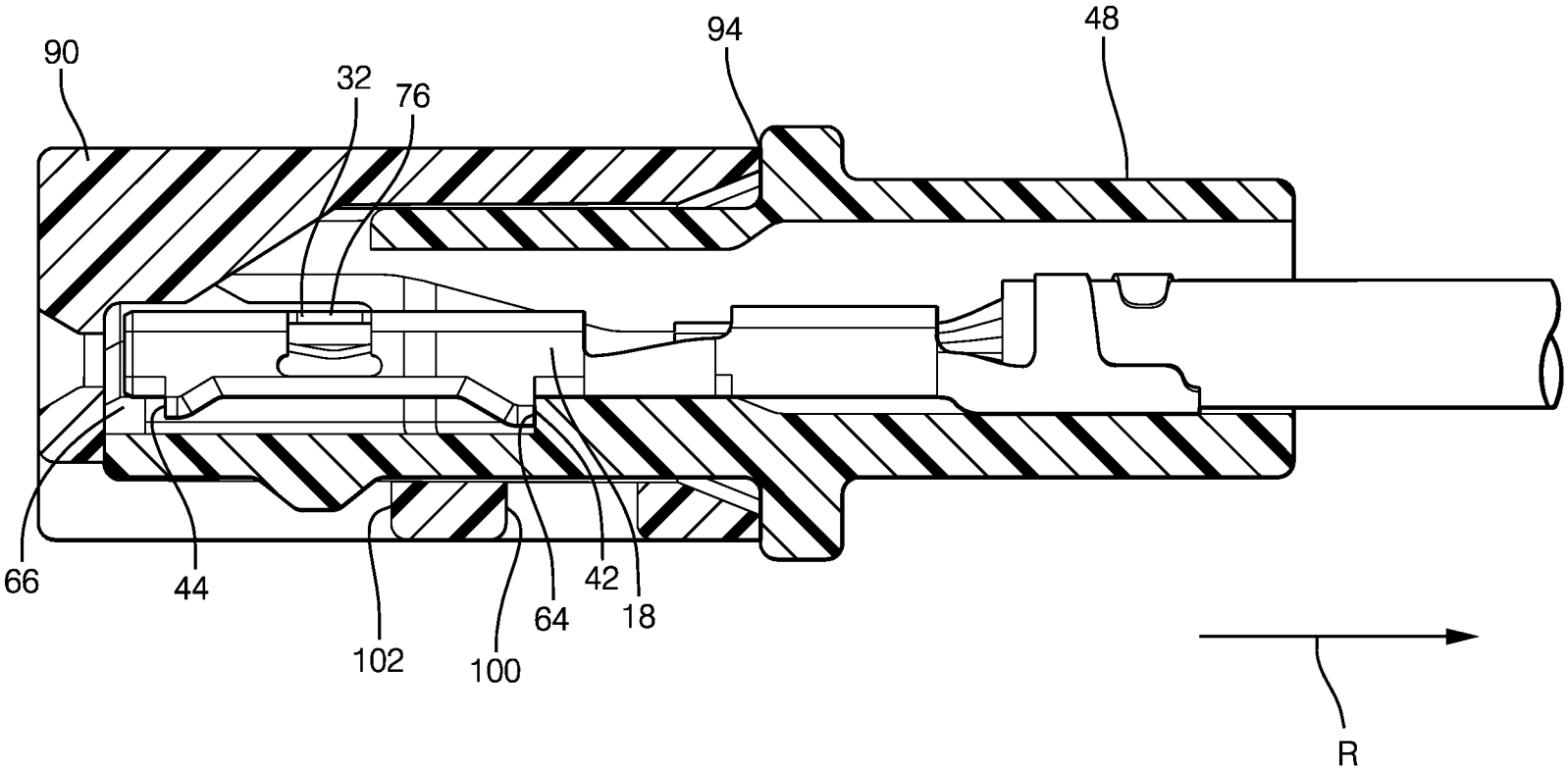
FIG. 8 is a side cross section view of the connector body and retainer of the electrical connector assembly of FIG. 1 as the rearward lock tab is the rearward lock surface within the terminal receiving cavity according to one embodiment.

As illustrated in FIG. 8, the wire 12 is withdrawn from the terminal receiving cavity 48 until the terminal 18 is pulled back into a position wherein the rearward face 42 of the rearward lock tab 38 of the terminal 18 engages the rearward lock surface 64 of the connector body 46, thereby inhibiting the terminal 18 from being further withdrawn from the terminal receiving cavity 48. As shown between FIGS. 6 and 8, the retainer 90 is moved from the initial position 92 to the final position 94 by moving the retainer tab 58 from the rearward side 100 of the retainer bar 98 to the forward side 102 of the retainer bar 98.

Figure 9:
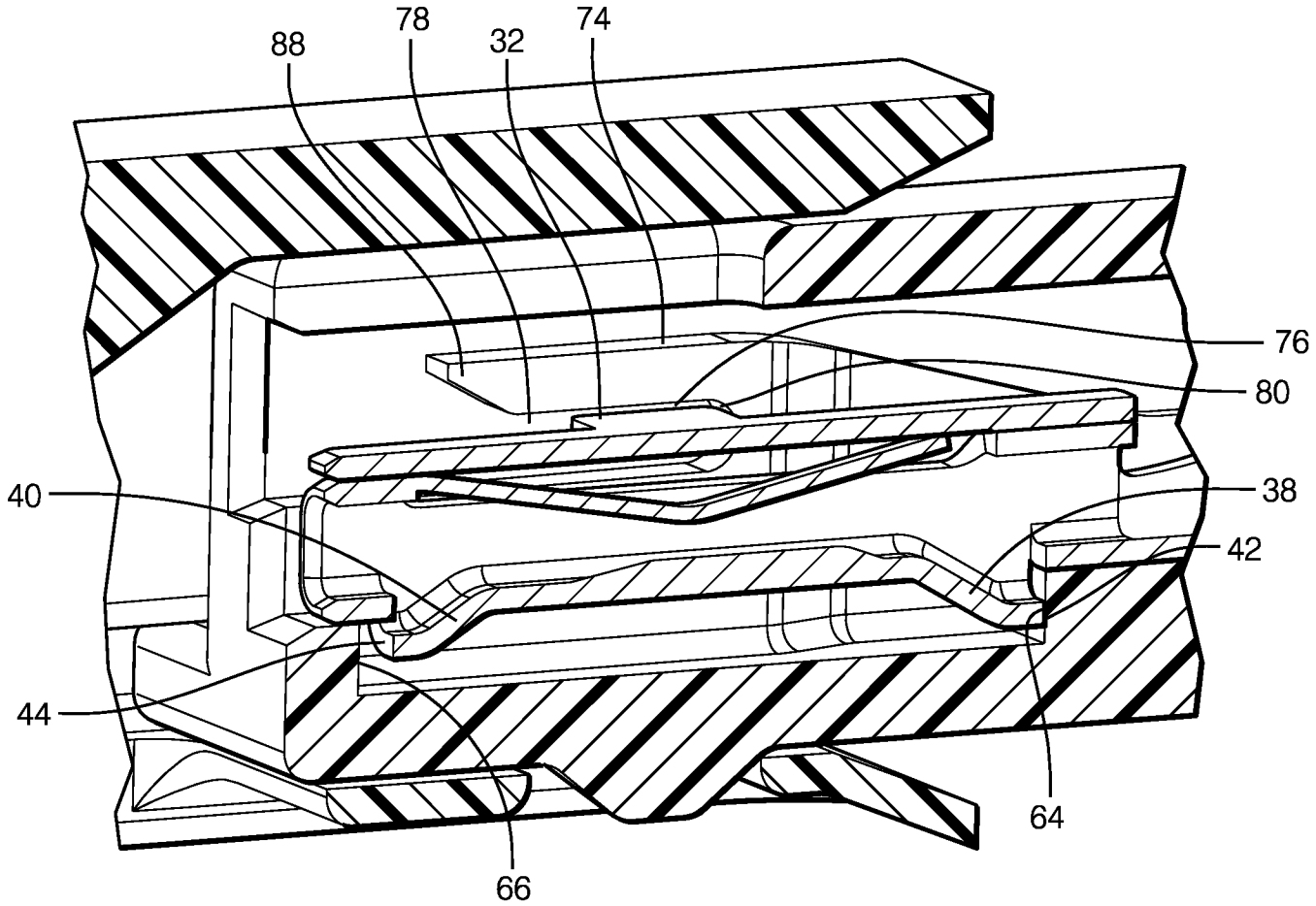
FIG. 9 is a perspective cross section view of the connector body and retainer of the electrical connector assembly of FIG. 1 as the rearward lock tab is the rearward lock surface within the terminal receiving cavity according to one embodiment.

The rearward lock tab 38 and the rearward lock surface 64 provide a primary rearward lock feature to prevent the terminal 18 from being inadvertently removed from the rearward opening 54 of the connector body 46. As best shown in FIG. 9, the terminal wings 32 and the closed ends 80 of the guide slots 76 provide a secondary rearward locking feature to prevent the terminal 18 from being inadvertently removed from the rearward opening 54 of the connector body 46. The forward lock tab 40 and forward lock surface 66 provide a primary forward locking feature to prevent the terminal 18 from being inadvertently removed from the forward opening 56 of the connector body 46. The retainer 90 and the forward opening 56 of the terminal 18 provide a secondary forward locking feature when the retainer 90 is in the final position 94.

According to the example illustrated in FIGS. 1-9, the terminal 18 is a female terminal and the mating terminal (not shown) is a male terminal. The forward end 20 of the terminal is open to receive the male terminal. Other embodiments of the invention may be envisioned wherein the terminal is a male terminal and the mating terminal is a female terminal.

The guide rails 74 in assembly 10 are rigid and fixed to the side walls 70. Alternative embodiments of the electrical connector assembly may be envisioned wherein a portion of the guide rails are not fixed to the side wall and are a flexible beam that can flex upwardly to allow the forward lock tab to more easily move over the forward ramp and the terminal is pulled rearwardly. These flexible beams may also be configured to apply a downward force to the terminal wings to more securely hold the terminal within the terminal receiving cavity. Although the flexible arms would increase a terminal insertion force, this force would only be increased while the terminal is being pulled rearward in the terminal. The wire is under tension while the terminal is being pulled rearwardly and the wire is less susceptible to bending than when the wire is under compression and the terminal is being pushed forwardly into the terminal receiving cavity.

The rearward lock tab 38 and rearward lock surface 64 provide the primary rearward locking feature of assembly 10. Alternative embodiments of the electrical connector assembly may be envisioned wherein the terminal wings and closed end of the guide slot may provide the primary rearward locking feature.

The assembly 10 has a single terminal 18 and the connector body 46 has a single terminal receiving cavity 48. Alternative embodiments of the electrical connector assembly may be envisioned wherein the electrical connector assembly includes a plurality of terminals within a plurality of terminal receiving cavities defined by the connector body.

According to alternative embodiments of the electrical connector assembly, the retainer may be an integral part of the connector body rather than a separate element. The retainer may be joined to the connector body by a flexible hinge feature.

According to alternative embodiments of the electrical connector assembly, the guide rail may extend to the rearward opening of the connector body and the rearward vertical ramp may be eliminated.

Accordingly an electrical connector assembly 10 is provided. The assembly 10 provided the benefit of a lower insertion force required to install the terminal 18 within the terminal receiving cavity 48 of the connector body 46. The assembly 10 provides primary locking features to inhibit the terminal 18 from inadvertently being withdrawn from either the forward or rearward opening 56, 54 of the connector body 46. The assembly 10 may also provide secondary locking features to inhibit the terminal 18 from inadvertently being withdrawn from either the forward or rearward opening 56, 54 of the connector body 46.

According to alternative embodiments of the electrical connector assembly, the terminal wings may be offset from the top surface of the terminal. The offset may differ between the two terminal wings as well, i.e. one of the terminal wings may protrude from one side surface lower than the other terminal wing protrudes from the opposing side surface.

According to alternative embodiments of the electrical connector assembly, the guide slots do not have a rearward closed end but are open on both the forward and rearward ends. In these embodiments, the guide slots do not provide a secondary locking surface. Since in these embodiments the rearward vertical ramps is open at the rearward end of the guide slot, the slope of the bottom vertical ramp is adjusted so that the terminal wings do not contact the guide ramps until the terminal wings are above the rearward ends of the guide slots.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. The terms top/bottom and forward/rearward as used herein to reference opposing sides or ends of the connector body 46, terminal 18, and/or retainer 90 and do not denote to any absolute or fixed orientation of the electrical connector assembly 10. As used herein, below is closer to the bottom side of the terminal receiving cavity 48 than the top side and above is closer to the top side of the terminal receiving cavity 48 than the bottom side.

We claim:

1. An electrical connector assembly, comprising:

a wire;

a terminal having a first end, a second end secured to the wire, and a terminal body between the first and second ends, said terminal body defining a pair of terminal wings protruding from opposite side surfaces of the terminal body;

a connector body having a terminal receiving cavity formed therein and having a first opening configured for insertion of the terminal therethrough and having a second opening opposite the first opening configured to receive a mating terminal therethrough, said terminal receiving cavity defined in part by a bottom wall, a top wall opposing the bottom wall, and two opposed side walls adjacent the top and bottom walls, each of said side walls defining terminal guides protruding into the terminal receiving cavity, said terminal guides having guide rails and a guide slots beneath the guide rails; and a retainer affixed to the second opening and configured to engage the first end of the terminal, thereby preventing the terminal from being inadvertently withdrawn from the terminal receiving cavity through the second opening, wherein the guide rails urge the pair of terminal wings toward the top wall as the terminal and the wire are inserted within the terminal receiving cavity through the first opening until the pair of terminal wings reach an end of the guide rails, and wherein the pair of terminal wings enter open ends of the guide slots as the wire is withdrawn from the terminal receiving cavity and the pair of terminal wings traverse the guide slots until the pair of terminal wings engage closed ends of the guide slots, thereby preventing the terminal from being inadvertently withdrawn from the terminal receiving cavity through the first opening.

2. The electrical connector assembly according to claim 1, wherein the bottom wall defines a first lock surface substantially perpendicular to the bottom wall, wherein a bottom surface of the terminal body defines a first lock tab proximate the second end of the terminal, and wherein the first lock tab is configured to engage the first lock surface, thereby preventing the terminal from being inadvertently withdrawn from the terminal receiving cavity through the first opening.

3. The electrical connector assembly according to claim 2, wherein the bottom wall defines a second lock surface substantially perpendicular to the bottom wall, wherein the bottom surface of the terminal body defines a second lock tab proximate the first end of the terminal, and wherein the second lock tab is configured to engage the second lock surface, thereby preventing the terminal from being inadvertently withdrawn from the terminal receiving cavity through the second opening.

4. The electrical connector assembly according to claim 1, wherein the retainer defines a retainer cavity defined in part by a lower wall and an upper wall opposing the lower wall and configured to receive the connector body and wherein the retainer is moveable from an initial position to a final position, and wherein the retainer allows insertion of the terminal into the terminal receiving cavity and entry of the pair of terminal wings into the open ends of the guide slots in the initial position and the retainer engages the first end of the terminal, thereby preventing the pair of terminal wings from disengaging the guide slots in the final position.

5. The electrical connector assembly according to claim 4, wherein the retainer cavity defines a cam surface forwardly sloping from the upper wall of the retainer cavity toward the lower wall of the retainer cavity and configured to engage the first end of the terminal as the pair of terminal wings reach the end of the guide rails, thereby biasing the pair of terminal wings to enter the open ends of the guide slots when the retainer is in the initial position.

6. The electrical connector assembly according to claim 1, wherein the terminal body is intermediate the guide rails as the terminal and the wire is inserted within the terminal receiving cavity through the first opening.

7. The electrical connector assembly according to claim 1, wherein the terminal is a female terminal and the mating terminal is a male terminal and wherein the first end of the terminal is open to receive the male terminal.

8. The electrical connector assembly according to claim 1, wherein the terminal is a male terminal and the mating terminal is a female terminal.

9. The electrical connector assembly according to claim 1, wherein the electrical connector assembly comprises a plurality of terminals and a plurality of wires secured to said plurality of terminals and wherein the connector body has a plurality of terminal receiving cavities formed therein.

10. An electrical connector assembly, comprising:

a wire;

a terminal having a forward end, a rearward end secured to the wire, and a terminal body between the forward and rearward ends, said terminal body defining a pair of terminal wings protruding from opposite side surfaces of the terminal body and a bottom surface of the terminal body defining a rearward lock tab proximate the rearward end of the terminal;

a connector body having a terminal receiving cavity formed therein and having a rearward opening configured for insertion of the terminal therethrough and having a forward opening opposite the rearward opening configured to receive a mating terminal therethrough, said terminal receiving cavity defined in part by a bottom wall having a rearward lock surface substantially perpendicular to the bottom wall, a top wall opposing the bottom wall, and two opposed side walls adjacent the top and bottom walls, each of said side walls defining terminal guides protruding into the terminal receiving cavity and having guide rails and a guide slots beneath the guide rails, each guide slot having a forward open end; and a retainer affixed to the forward opening and having a retainer cavity defined in part by a lower wall and an upper wall opposing the lower wall and configured to receive the connector body, the retainer cavity defining a cam surface forwardly sloping from the upper wall of the retainer cavity toward the lower wall of the retainer cavity, wherein the guide rails are configured to urge the pair of terminal wings toward the top wall as the terminal and the wire are inserted into the terminal receiving cavity in a forward direction until the forward end of the terminal engages the cam surface of the retainer, thereby urging the pair of terminal wings toward the forward open ends of the guide slots, and wherein the open ends of the guide slots are configured to receive the pair of terminal wings as the terminal and the wire are moved in a rearward direction, the pair of terminal wings configured to traverse the guide slots until the rearward lock tab engages the rearward lock tab, thereby preventing the terminal from being inadvertently withdrawn from the terminal receiving cavity through the rearward opening.

11. The electrical connector assembly according to claim 10, wherein the bottom wall defines a forward lock surface substantially perpendicular to the bottom wall, wherein the bottom surface of the terminal body defines a forward lock tab proximate the forward end of the terminal, and wherein the forward lock tab is configured to engage the forward lock surface, thereby preventing the terminal from being inadvertently withdrawn from the terminal receiving cavity through the forward opening.

12. The electrical connector assembly according to claim 10, wherein the retainer is configured to engage the forward end of the terminal, thereby preventing the terminal from being inadvertently withdrawn from the terminal receiving cavity through the forward opening.

13. The electrical connector assembly according to claim 10, wherein the retainer is moveable from an initial position to a final position, wherein in the initial position the retainer allows insertion of the terminal into the terminal receiving cavity and entry of the pair of terminal wings into the open ends of the guide slots, and wherein in the final position the retainer engages the forward end of the terminal, thereby preventing the pair of terminal wings from disengaging the guide slots.

14. The electrical connector assembly according to claim 10, wherein the terminal body is intermediate the guide rails as the terminal and the wire is inserted within the terminal receiving cavity through the rearward opening.

15. The electrical connector assembly according to claim 10, wherein each guide slot has a rearward closed end and wherein the pair of terminal wings engage the rearward closed ends of the guide slots, thereby preventing the terminal from being inadvertently withdrawn from the terminal receiving cavity through the rearward opening.

16. The electrical connector assembly according to claim 10, wherein the terminal is a female terminal and the mating terminal is a male terminal and wherein the forward end of the terminal is open to receive the male terminal.

17. The electrical connector assembly according to claim 10, wherein the terminal is a male terminal and the mating terminal is a female terminal.

18. The electrical connector assembly according to claim 10, wherein the electrical connector assembly comprises a plurality of terminals and a plurality of wires secured to said plurality of terminals and wherein the connector body has a plurality of terminal receiving cavities formed therein.

* * * * *